US009022738B1

(12) United States Patent
Silberg et al.

(10) Patent No.: US 9,022,738 B1
(45) Date of Patent: May 5, 2015

(54) MARINE PROPULSION-AND-CONTROL SYSTEM IMPLEMENTING ARTICULATED VARIABLE-PITCH PROPELLERS

(75) Inventors: Eric J. Silberg, Potomac, MD (US); Daniel Everson, Joppa, MD (US); David J. Haas, North Potomac, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 702 days.

(21) Appl. No.: 13/336,348

(22) Filed: Dec. 23, 2011

(51) Int. Cl.

| | |
|---|---|
| ***B63G 8/16*** | (2006.01) |
| ***B63H 25/42*** | (2006.01) |
| ***B63H 5/10*** | (2006.01) |
| ***B63G 8/00*** | (2006.01) |

(52) U.S. Cl.
CPC *B63G 8/16* (2013.01); *B63G 8/001* (2013.01); *B63H 25/42* (2013.01); *B63H 5/10* (2013.01)

(58) Field of Classification Search
CPC ..... B64C 27/605; B64C 27/59; B64C 27/39; B64C 27/41; B64C 27/54; B64C 29/0033; B63H 3/002; B63H 5/10; B63H 5/125; B63H 25/42; B63H 25/46; B63H 2001/105; B63H 2005/1258; B63G 8/001; B63G 8/16
USPC ..... 416/25, 27, 30, 31, 33–35, 55, 61, 103, 416/104, 128, 129, 131, 147, 153, 172, 416/198 R, 199
See application file for complete search history.

(56) References Cited

U.S. PATENT DOCUMENTS

| | | | |
|---|---|---|---|
| 2,727,485 | A | 12/1955 | Combs |
| 2,806,441 | A | 9/1957 | Hoke, Jr. |
| 3,101,066 | A | 8/1963 | Haselton |
| 3,291,086 | A | 12/1966 | Haselton |
| 3,450,083 | A | 6/1969 | Haselton et al. |

(Continued)

OTHER PUBLICATIONS

"Helicoptor Rotor", Nov. 17, 2007, Wikipedia, p. 2.*

(Continued)

*Primary Examiner* — Dwayne J White
*Assistant Examiner* — Alexander White
(74) *Attorney, Agent, or Firm* — Howard Kaiser

(57) ABSTRACT

According to typical inventive practice, a cylindrical or prolate spheroidal marine hull has two congruent contra-rotative propellers coaxially situated at or near its axial ends. Each propeller has plural blades mechanically and/or flexibly attributed with changeability of blade pitch angles and blade flap angles. A blade-pitch control system adjusts the individual blade pitch angles of both propellers. The blade-pitch control system may be electronically and/or mechanically actuated, and is capable of: (i) cyclically adjusting the blade pitch angles of the two propellers so as to select two respective blade-tip-path planes, each characterized by a direction of thrust that is associated with the blade flap angles and is generally perpendicular to the blade-tip-path plane; (ii) collectively adjusting the blade pitch angles of the two propellers so as to select two respective magnitudes of thrust. The cyclic and collective blade commands, algorithmically coordinated, determine the direction, orientation, and speed of the hull.

20 Claims, 6 Drawing Sheets

(56) References Cited

U.S. PATENT DOCUMENTS

| | | | | |
|---|---|---|---|---|
| 3,703,211 | A | 11/1972 | Bernaerts | |
| 3,717,114 | A | 2/1973 | Bernaerts | |
| 3,986,471 | A | 10/1976 | Haselton | |
| 4,054,104 | A | 10/1977 | Haselton | |
| 4,207,028 | A | 6/1980 | Ridder | |
| 4,540,341 | A | 9/1985 | Wuhrer | |
| 4,648,345 | A | 3/1987 | Wham et al. | |
| 4,957,413 | A | 9/1990 | Reich et al. | |
| 5,028,210 | A | 7/1991 | Peterson et al. | |
| 5,249,992 | A | 10/1993 | Schneider | |
| 6,485,272 | B2 | 11/2002 | Mueller | |
| 7,264,202 | B2 | 9/2007 | Sullivan | |
| 7,841,290 | B1 | 11/2010 | Reitz et al. | |
| 2010/0048069 | A1* | 2/2010 | Duncan | 440/50 |

OTHER PUBLICATIONS

"Transmission (mechanics)", Jul. 23, 2005, Wikipedia, p. 1.*

Alistair Robin Palmer, "Analysis of the Propulsion and Manoeuvring Characteristics of Survey-Style AUVs and the Development of a Multi-Purpose AUV," thesis for the degree of Doctor of Engineering, University of Southampton, School of Engineering Sciences, dated Sep. 2009 (226 pages).

Gerald M. Stenovec, F.R. Haselton (consultant), "An Efficient Propulsion System for Untethered Submersible Vehicles," Proceedings of the 1987 5th International Symposium on Unmanned Untethered Submersible Technology, Jun. 1987, pp. 371-380, available on ieee.org.

* cited by examiner

MARINE PROPULSION-AND-CONTROL SYSTEM IMPLEMENTING ARTICULATED VARIABLE-PITCH PROPELLERS

BACKGROUND OF THE INVENTION

The present invention relates to propulsion and control of underwater vehicles, more particularly to dual-propeller-based systems for accomplishing same with regard to submersibles such as unmanned underwater vehicles (UUVs).

Current methodologies for underwater propulsion and control require multiple systems in order to provide efficient cruise power and low-speed control. Conventional rigid propellers afford good thrust but poor lateral and off-axis control (i.e., control of lateral forces and moments). Conventional underwater vehicles seek to overcome such deficiencies by implementing additional devices, e.g., rudders and planes for lateral control. Rudders and planes, however, are ineffective at low speeds or while hovering. Although thrusters can be implemented to provide multi-axis control, they require axis-independent units and are not suited for high-speed or high-efficiency applications.

Frederick R. Haselton introduced about fifty years ago, and subsequently developed, his basic concept of an underwater vehicle propulsion-and-control system involving a pair of fore-and-aft coaxial contra-rotating propellers. Haselton sometimes referred to his concept as the "Tandem Propeller System," or "TPS." Haselton taught the coordinated control of the "cyclic" and "collective" blade pitch of the blades on each propeller in order to propel and maneuver his vehicle, in his words, "in six degrees of freedom." Cyclic blade control changes the pitch angle of each propeller blade in accordance with the blade position in a cycle (one complete blade rotation about the propeller hub); every blade changes its pitch angle to the same degree at the same point in the cycle. Collective blade control changes the pitch angle of all of the propeller blades equally and simultaneously, and independently of the blade position. Haselton originally disclosed electromechanical blade pitch control, and later disclosed electronic blade pitch control.

The term "six degrees of freedom" is conventionally used to describe both translational motion and rotational motion of a body with respect to three perpendicular axes in three-dimensional space. In general, a marine vessel is characterized by motion describable in terms of six degrees of freedom, viz., heave, surge, sway, roll, pitch, and yaw. The three kinds of translational ship motion are commonly referred to as heave (linear movement along a vertical axis), surge (linear movement along a horizontal fore-and-aft axis), and sway (linear movement along a horizontal port-and-starboard axis). The three kinds of rotational ship motion are commonly referred to as roll (rotational movement about a horizontal fore-and-aft axis), pitch (rotational movement about a horizontal port-and-starboard axis), and yaw (rotational movement about a vertical axis).

Pertinent to the instant disclosure are the following United States patents to Haselton, each of which is incorporated herein by reference: Frederick R. Haselton, U.S. Pat. No. 3,101,066, issued 20 Aug. 1963, entitled "Submarine Hydrodynamic Control System"; Frederick R. Haselton, U.S. Pat. No. 3,291,086, issued 13 Dec. 1966, entitled "Tandem Propeller Propulsion-and-control System"; Frederick R. Haselton et al., U.S. Pat. No. 3,450,083, issued 17 Jun. 1969, entitled "Submarine Hydrodynamics Control System"; Frederick R. Haselton, U.S. Pat. No. 3,986,471, issued 19 Oct. 1976, entitled "Semi-Submersible Vessels"; Frederick R. Haselton, U.S. Pat. No. 4,054,104, issued 18 Oct. 1977, entitled "Submarine Well Drilling and Geological Exploration Station"; John L. Wham et al., U.S. Pat. No. 4,648,345, issued 10 Mar. 1987, entitled "Propeller System with Electronically Controlled Cyclic and Collective Blade Pitch."

As evidenced by the above-noted patents to Haselton, the concept of a cyclically and collectively controllable propulsor for effecting vectored thrust in a marine power system has been known for some time. Other literature disclosing cyclic and collective blade pitch control of a marine propeller includes the following two U.S. patents, each incorporated herein by reference: Frank B. Peterson et al., U.S. Pat. No. 5,028,210, issued 2 Jul. 1991, entitled "Propeller Unit with Controlled Cyclic and Collective Blade Pitch"; William E. Schneider, U.S. Pat. No. 5,249,992, issued 5 Oct. 1993, entitled "Marine Propulsion Unit with Controlled Cyclic and Collective Blade Pitch." In addition, the skilled artisan who reads the instant disclosure will be familiar with the well-known practices and plethora of literature relating to cyclic and collective blade pitch control in helicopters and other rotor aircraft.

The United States Navy has investigated over many years the generation, through the use of non-articulating variable-pitch blades, of control and translation forces and moments in marine vessels. See, e.g., H. Weiner, "Conceptual Design and Model Investigation of the Propulsion, Stability and Control Characteristics of a Small Tandem Propeller Submarine (TPS Scheme B," Report 416-H-01, David W. Taylor Naval Ship Research and Development Center (now known as the Naval Surface Warfare Center, Carderock Division, or "NSWCCD"), Bethesda, Md. More recent work (such as by Benjamin Y.-H. Chen, Stephen K. Neely, Kurt A. Junghans, and David P. Bochinski of NSWCCD, and David C. Robinson of the U.S. Naval Academy) has focused on investigating the application of these concepts to small UUVs. A recent prototype according to Y.-H. Chen et al. has demonstrated significant improvements in control at low speeds, but has also demonstrated significant limitations with respect to sideward translational motion.

SUMMARY OF THE INVENTION

In view of the foregoing, it is an object of the present invention to provide an improved methodology for effecting propulsion and control of underwater vehicles.

A Haselton-type propulsion-and-control system, as is currently known, utilizes tandem fore-and-aft coaxial contra-rotating propellers that are variable in blade pitch but are otherwise fixed, that is, are "non-articulated." Although traditional Haselton propulsors afford some degree of multi-axis control, they are limited in their maneuverability and thrust-vectoring capability. The use of additional or alternative devices, such as thruster groups and moveable propulsor pods, is also limited in same or similar respects.

As distinguished from conventional practice of Haselton-type propellers, the present invention features, inter alia, Haselton-type propellers that not only are variable-pitch but also are "articulated." According to typical embodiments of the present invention, tandem fore-and-aft coaxial contra-rotating articulated variable-pitch propellers are associated with a marine vehicle, and are implemented so as to effect propulsion and control of the marine vehicle. As typically embodied, the present invention's tandem fore-and-aft coaxial contra-rotating marine propellers are both (i) variable-pitch (i.e., both cyclically and collectively variable in blade pitch angle) and (ii) articulated.

The present invention is typically embodied as a propulsion-and-control system for association with an elongate marine vehicle having two opposite longitudinal-axial ends. The inventive propulsion-and-control system includes two propellers and a blade-pitch control subsystem. The propellers are for coaxial situation at the opposite longitudinal-axial ends. Each propeller has plural blades. Each blade is characterized by pitch angle variability and by flappability. The blade-pitch control subsystem is for controlling the pitch of the blades of each propeller as it rotates. The blade-pitch control system is capable of cyclically varying the respective pitch angles of the blades in order to select, for each propeller, a tip-path plane related to the flappability. In each propeller, the direction of thrust of the propeller is perpendicular to the corresponding tip-path plane, with corrections for other forces produced by the drag of the blades. The combined thrusts determine the overall direction of thrust of the vehicle, and hence the direction of motion of the vehicle. The computer is further capable of collectively varying the respective pitch angles of the blades in order to determine the amount of thrust of each propeller. The combined thrusts determine the overall amount of thrust of the vehicle and the axial-longitudinal direction of motion of the vehicle.

The present invention's articulation of the two propellers of a Haselton-type configuration is believed to be novel in the art. The inventive articulation may be practiced in any of diverse modes. The present invention's new Haselton-type propulsion-and-control systems afford improved maneuverability of marine vehicles in six degrees of freedom. In particular, inventive practice produces multi-direction, off-axis forces (thrust vectoring) implementing two coaxial fore-and-aft propellers. A marine vehicle that is inventively propelled and controlled can translate or rotate in any direction, regardless of vehicle speed through the water.

The present invention was to some extent motivated through the present inventors' participation in the Navy's work on the aforementioned recent UUV prototype having a Haselton-type propulsion-and-control system. The present inventors applied their rotorcraft expertise to the lessons learned in testing the Navy prototype. The articulated rotor systems that are commonly employed in helicopters can generate large in-plane forces and moments to affect control independent of thrust. The present invention borrows from known aeromechanical concepts of helicopter rotor technology so as to impart to an underwater vehicle (such as a UUV) the ability to translate and rotate in any direction using contra-rotating, cyclically pitch-controllable, collectively pitch-controllable, and articulated propulsors.

Although the inventive marine propulsion-and-control system lends itself to a variety of applications, inventive practice is particularly efficacious in association with small-to-medium sized unmanned underwater vehicles (UUVs). Inventive practice affords UUV maneuverability and control that are not possible by means of current UUV technology, and thus enables missions that at present cannot be executed. For instance, inventive practice can achieve precision station keeping in unsteady currents, variable-angle vehicle positioning, and translation independent of orientation—and can do so while maintaining the ability to efficiently cruise at speed.

Other objects, advantages, and features of the present invention will become apparent from the following detailed description of the present invention when considered in conjunction with the accompanying drawings.

BRIEF DESCRIPTION OF THE DRAWINGS

The present invention will now be described, by way of example, with reference to the accompanying drawings, wherein:

FIG. 5 and FIG. 6 each show a single blade. The view of FIG. 5 faces the blade edge in a direction perpendicular to the blade's geometric axis and along the geometric plane general described by the propeller. The view of FIG. 6 faces the blade tip in the direction of the blade's geometric axis. The view of FIG. 7 is similar to the view of FIG. 1.

FIGS. 10 and 11 schematically illustrate blade pitch control and propeller powering, respectively, in accordance with this example of inventive practice.

DESCRIPTION OF EXEMPLARY EMBODIMENTS OF THE INVENTION

Figures 1, 2, 3, 4:
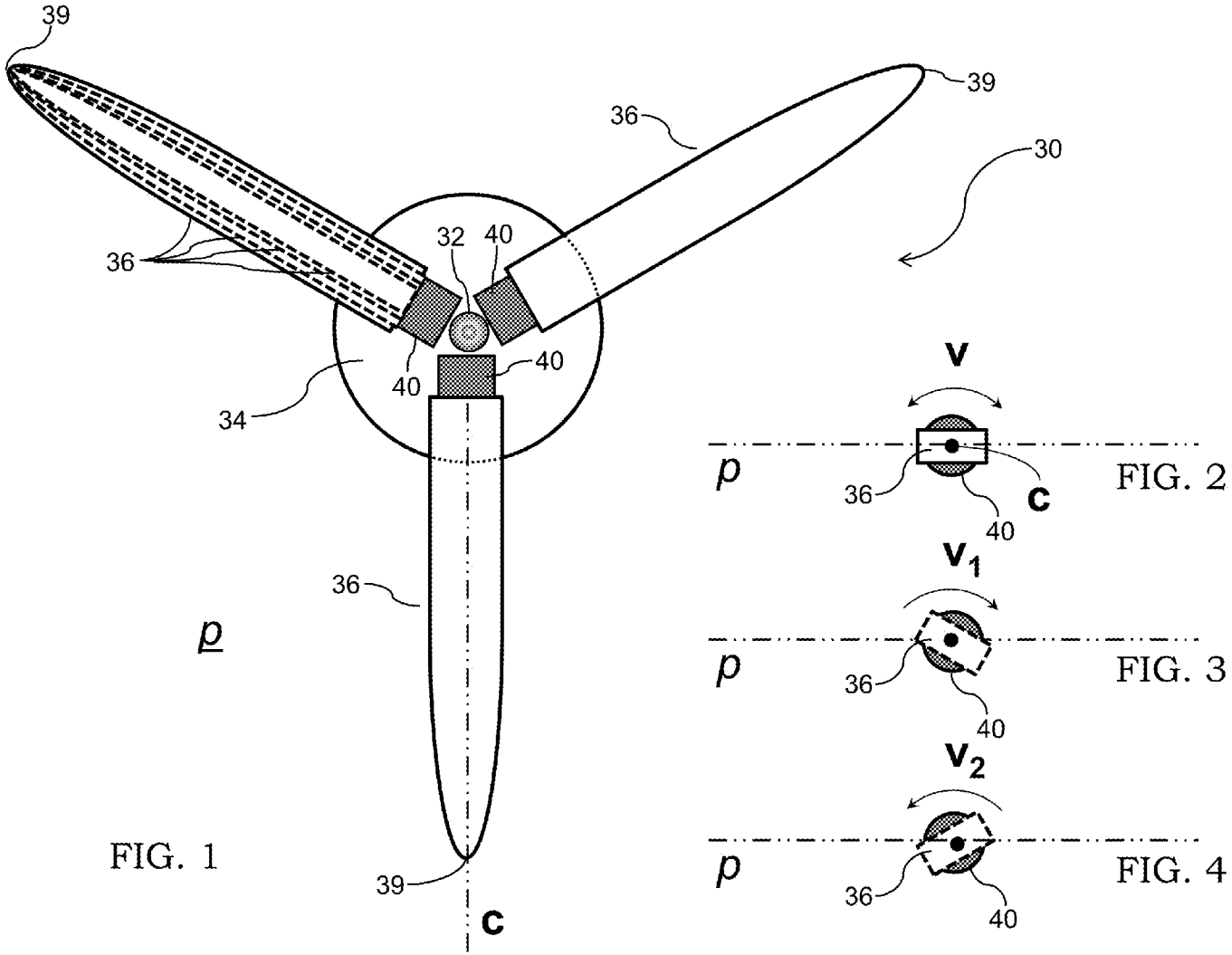
FIG. 1 through FIG. 4 diagrammatically exemplify pitch angle variability of a three-bladed propeller representative of a propeller in accordance with the present invention. The view of FIG. 1 is of the entire propeller, facing the three-bladed propeller in a direction perpendicular to the geometric plane generally described by the three-bladed propeller. Each of the views of FIGS. 2-4 is of a single propeller blade, facing the blade tip in the direction of the blade's geometric axis, which lies in the geometric plane generally described by the propeller.
Figures 7, 8:
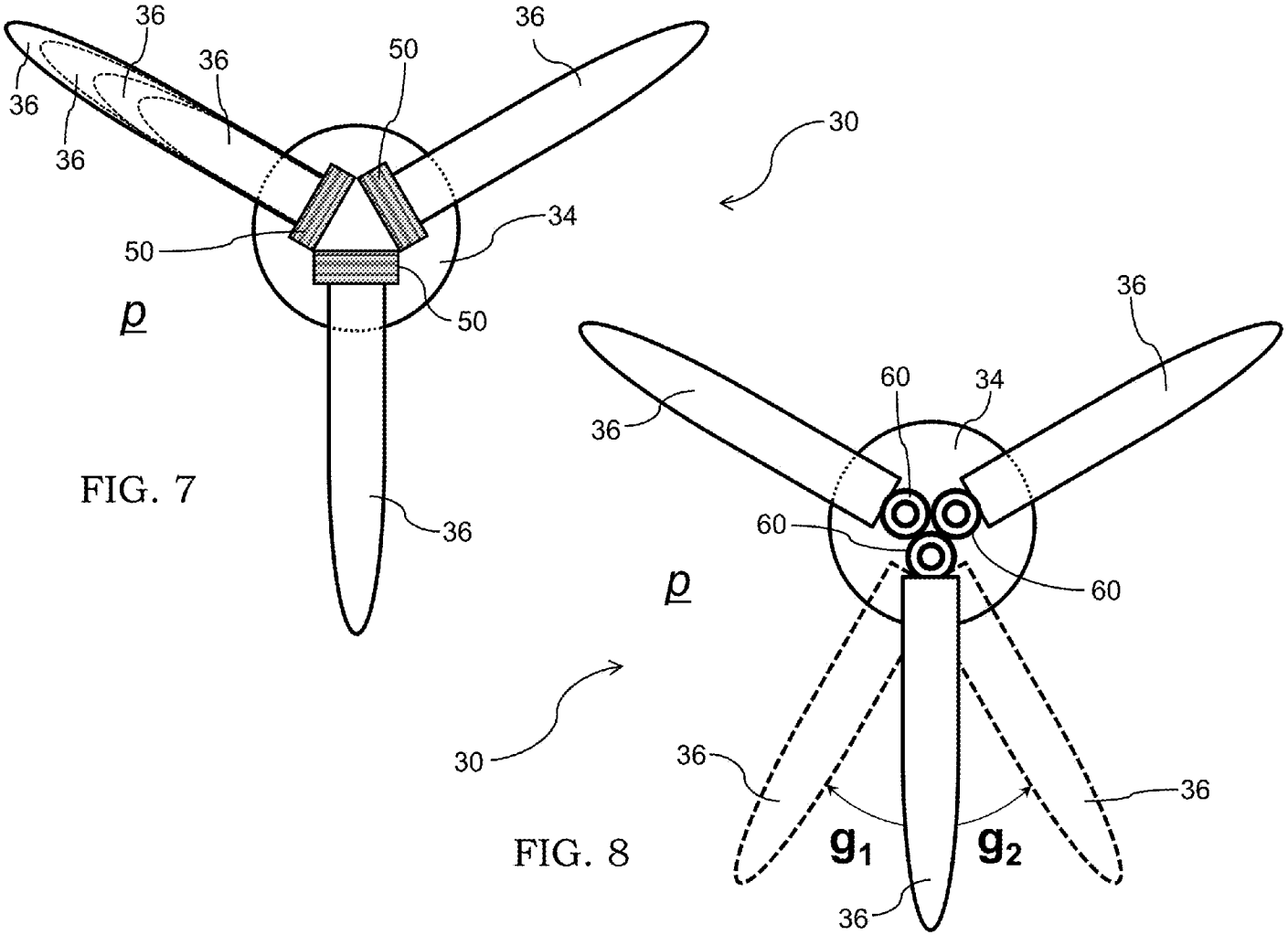
FIG. 8 is a view similar to the views of FIG. 1 and FIG. 7 and diagrammatically exemplifies lead-lag variability of the three-bladed propeller shown in FIGS. 1-7.

Referring now to the figures and particularly to FIGS. 1, 7, and 8, three-bladed propeller 30 includes a propeller shaft 32, a propeller hub 34, and three propeller blades 36. Each blade 36 has a blade tip 39. Blades 36 are arranged symmetrically about the central hub 34 in a generally coplanar manner so as to approximately define a geometric plane p that is perpendicular to shaft 32. Each blade 36 is generally characterized by a geometric longitudinal axis c that generally lies in geometric plane p, which generally describes the geometric rotational plane of propeller 30. Plane p represents the "zero-angle tip-path plane"—i.e., the geometric plane in which normally lies the path of the blade tips 39.

The depictions herein of propellers are diagrammatic and are not intended to convey specificity or preference with regard to blade shapes and other geometric aspects of propellers. The skilled artisan who reads the instant disclosure will appreciate that inventive principles are applicable to diverse propulsive forms and configurations. Although inventive practice can provide for practically any plural number of blades in a propeller, many inventive embodiments use three-bladed propellers such as exemplified in FIGS. 1 through 8.

As illustrated in FIGS. 1 through 4, propellers 30 are each characterized by blade pitch variability. In each propeller 30, the blades 36 are individually connected to a corresponding pitch-variability hinge 40 so as to be up to 360° rotatable, about its axis c in bi-direction v, either clockwise (direction $v_1$ as shown in FIG. 3) or counterclockwise (direction $v_2$ as shown in FIG. 4). Each blade 36 can rotate about its axis c so as to describe a pitch angle relative to geometric zero-angle tip-path plane p. The respective "feathering" rotations of blades 36 are controlled by a system such as pitch-angle control subsystem 80 shown in FIG. 11. The pitch angles of blades 34 can be varied either cyclically, or collectively, or both cyclically and collectively. The terms "pitch angle" and "pitch" are used interchangeably herein to refer to the afore-described geometric characteristic of a propeller blade.

Figure 5:
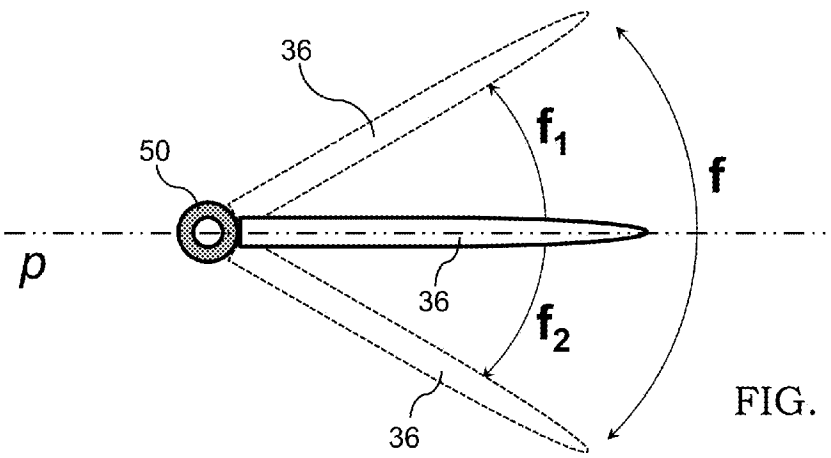
FIG. 5 through FIG. 7 diagrammatically exemplify flap angle variability of the three-bladed propeller shown in FIGS. 1-4.
Figure 6:
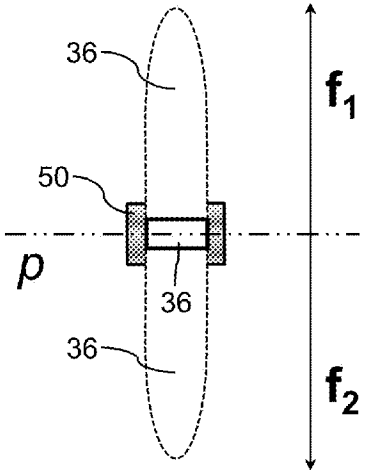

With reference to FIGS. 5 through 7, three-bladed propellers 30 are each characterized by "flapping" articulation. In each propeller 30, each blade 36 of propeller 30 is at least somewhat freely rotatable, typically at least 30° and possibly up to 180°, depending on the inventive embodiment. Rotatability of each blade 36 is via flapping hinge 50, in bi-direction f. By varying the pitch angle of each blade (such as depicted in FIGS. 1 through 4), each blade 36 is flappingly adjustable so as to be disposed either in-plane or out-of-plane with respect to geometric plane p. Blade 36 can be caused to rotate either clockwise or counterclockwise in bi-direction f so as to be disposed at any selected angle with respect to geometric plane p.

For instance, blade 36 can be caused to be oriented in-plane, i.e., at a zero degree angle with respect to geometric plane p. Blade 36 can be caused to be rotated out-of-plane in direction $f_1$ so as to be oriented at any selected positive angle with respect to geometric plane p, or can be oppositely rotated, in direction $f_2$, so as to be disposed at any selected negative angle with respect to geometric plane p. Blade 36 is shown by way of example in FIG. 5 to be positionable, via $f_1$ rotation, at approximately a positive thirty-degree angle with respect to geometric plane p, or to be positionable, via $f_2$ rotation, at approximately a negative thirty-degree angle with respect to geometric plane p.

Figure 9:
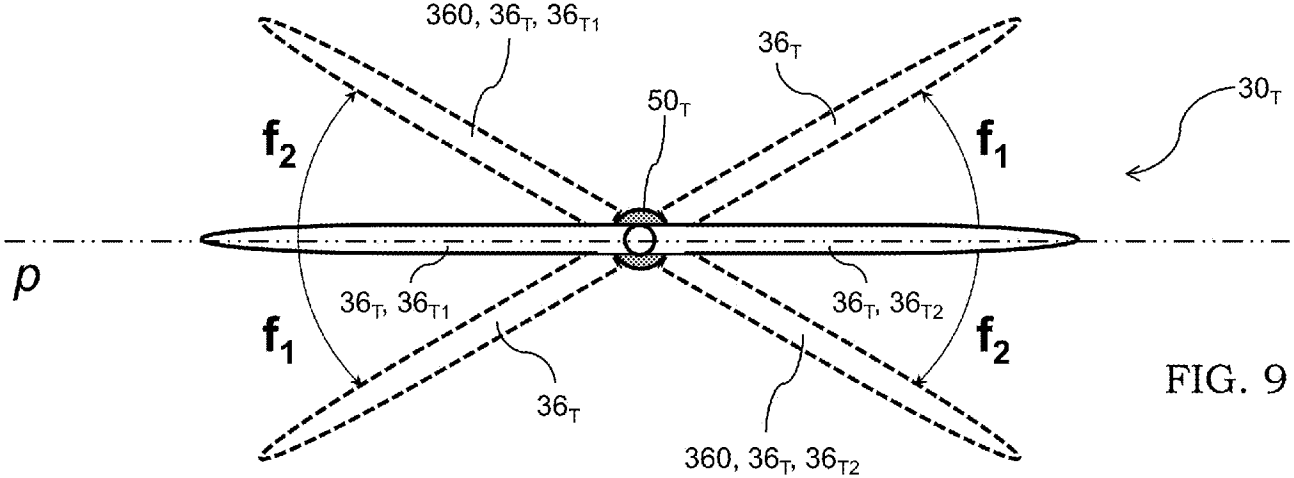
FIG. 9 is a view similar to the view of FIG. 5 and diagrammatically exemplifies flap angle variability of a propeller different from the three-bladed propeller shown in FIGS. 1-4. The propeller of FIG. 9 includes at least one "double-blade" combination as shown, coaxially and oppositely connected at the hub and medially pivotable ("teetering") about a hub fulcrum as a single blade unit.

Similarly as FIG. 7 illustrates individual flappability of each blade 36 in propeller 30, FIG. 9 illustrates "see-saw" flappability of a double-blade structure 360 in propeller $\mathbf{30}_T$. For instance, an inventively practiced propeller may be a two-bladed propeller $\mathbf{30}_T$ having a single double-blade structure 360. Double-blade structure 360 is essentially a single diametric blade formed by two equivalent coaxially joined radial blades $\mathbf{36}_T$, viz., $\mathbf{36}_{T1}$ and $\mathbf{36}_{T2}$. Double-blade structure 360 "teeters" about its middle, located in hub 34. Two-bladed propeller $\mathbf{30}_T$ articulates by pivoting about teetering-type flapping hinge $\mathbf{50}_T$. A two-bladed propeller $\mathbf{30}_T$ may be analogous in theory and operation to a simple articulated two-bladed rotor that is installed on some helicopters. Blade pitch on each propeller $\mathbf{30}_T$ can be controlled cyclically and collectively through a swashplate via pitch links attached to blade grips. The propeller $\mathbf{30}_T$ flappingly articulates by pivoting about teetering hinge $\mathbf{50}_T$.

Typical inventive practice provides for propellers that are: (i) controllably variable in blade pitch angle; and, (ii) articulated in terms of blade flapping. Inventive practice featuring this combination of attributes, of each of two longitudinally-axially extreme propellers, is sufficient to impart a significantly greater amount of control and maneuverability to an underwater vehicle than has been achievable in non-inventive practice.

FIG. 8 depicts how each three-bladed propeller 30, in addition to pitch-variability and flapping articulation, may also be characterized by "lead-lag" articulation. According to some inventive embodiments, lead-lag articulation is "added to the blade-rotational mix," so to speak, in order to enhance the rotational motion harmonics of the inventive propulsion and compensate for forces due to the other blade motions that would otherwise cause vibrations. Each blade 30 is at least somewhat freely rotatable in bi-direction g about lead-lag hinge 60 in geometric plane p, generally the plane of rotation of propeller 30. Lead-lag rotation may be clockwise (such as indicated by lead-lag direction $g_1$) or counterclockwise (such as indicated by lead-lag direction $g_2$).

Inventive practice of pitch variability, flapping articulation, and lead-lag articulation share the characteristic of blade rotatability via a hinging device such as pitch-variability hinge 40, flapping hinge 50, and lead-lag hinge 60, respectively. The term "hinge," as used herein in the context of inventive practice, broadly refers to a device that is jointed and/or flexible in nature, and that permits the rotating, turning, or pivoting of an object relative to another object. In operation, each inventively practiced hinge—whether a pitch-variability hinge, a flapping hinge 50, or a lead-lag hinge—can be mechanical or flexible or both. For instance, a hinge that is "flexible" may include an elastomeric material to facilitate the hinging motion. Flex beam blades may be especially useful when individual control of blades 36 is applied.

The skilled artisan who reads the instant disclosure will appreciate that diverse hinge types customarily used for foils in rotor aircraft lend themselves to use in inventive practice. All three kinds of hinging movement—pitch angle variability, flapping, and lead-lag—are known in rotor aircraft technology. For instance, the term "fully articulating" has been conventionally used to describe the ability of the blades of a helicopter rotor to move in three ways, that is, in terms of pitch angle, flapping, and lead-lag.

Figure 10:
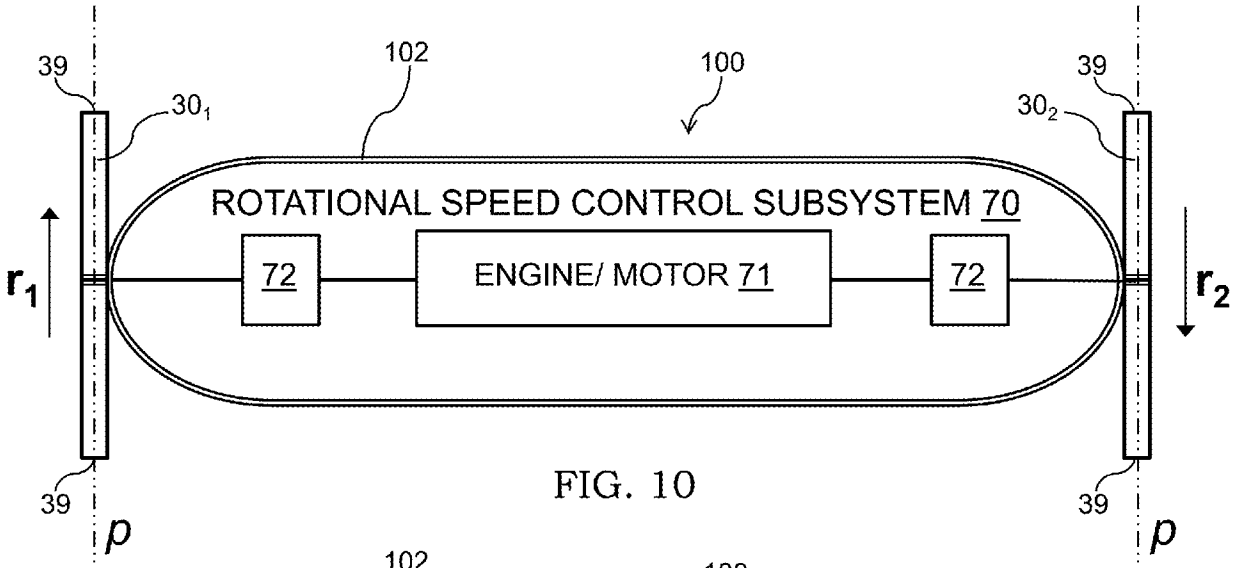
FIG. 10 and FIG. 11 exemplify an underwater marine vehicle equipped with an inventive propulsion-and-control system including tandem coaxial contra-rotating articulated variable-pitch propellers such as illustrated in previous figures.
Figure 11:
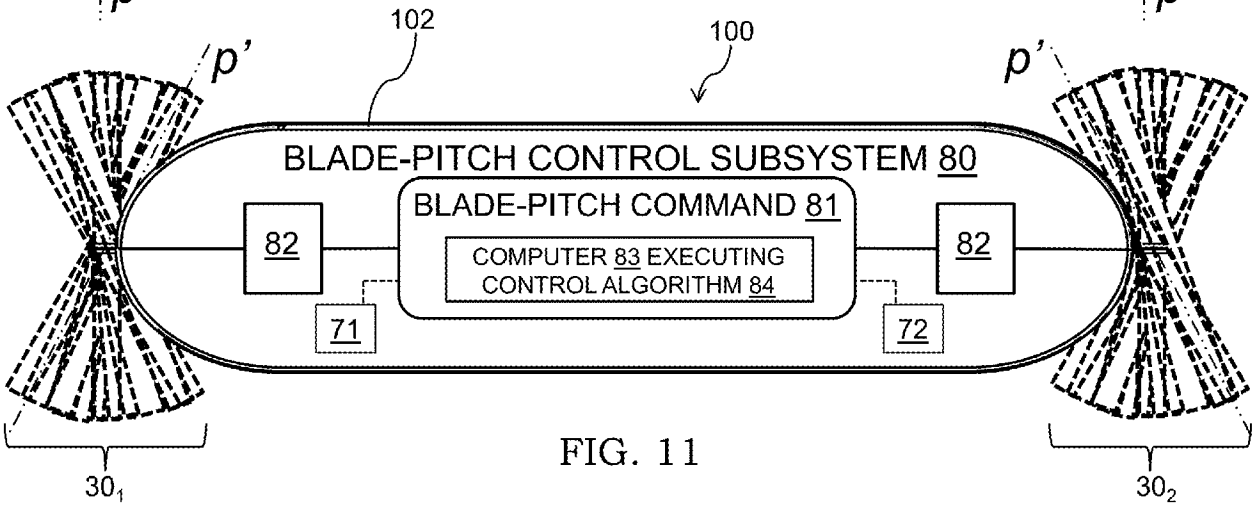
Figure 12:
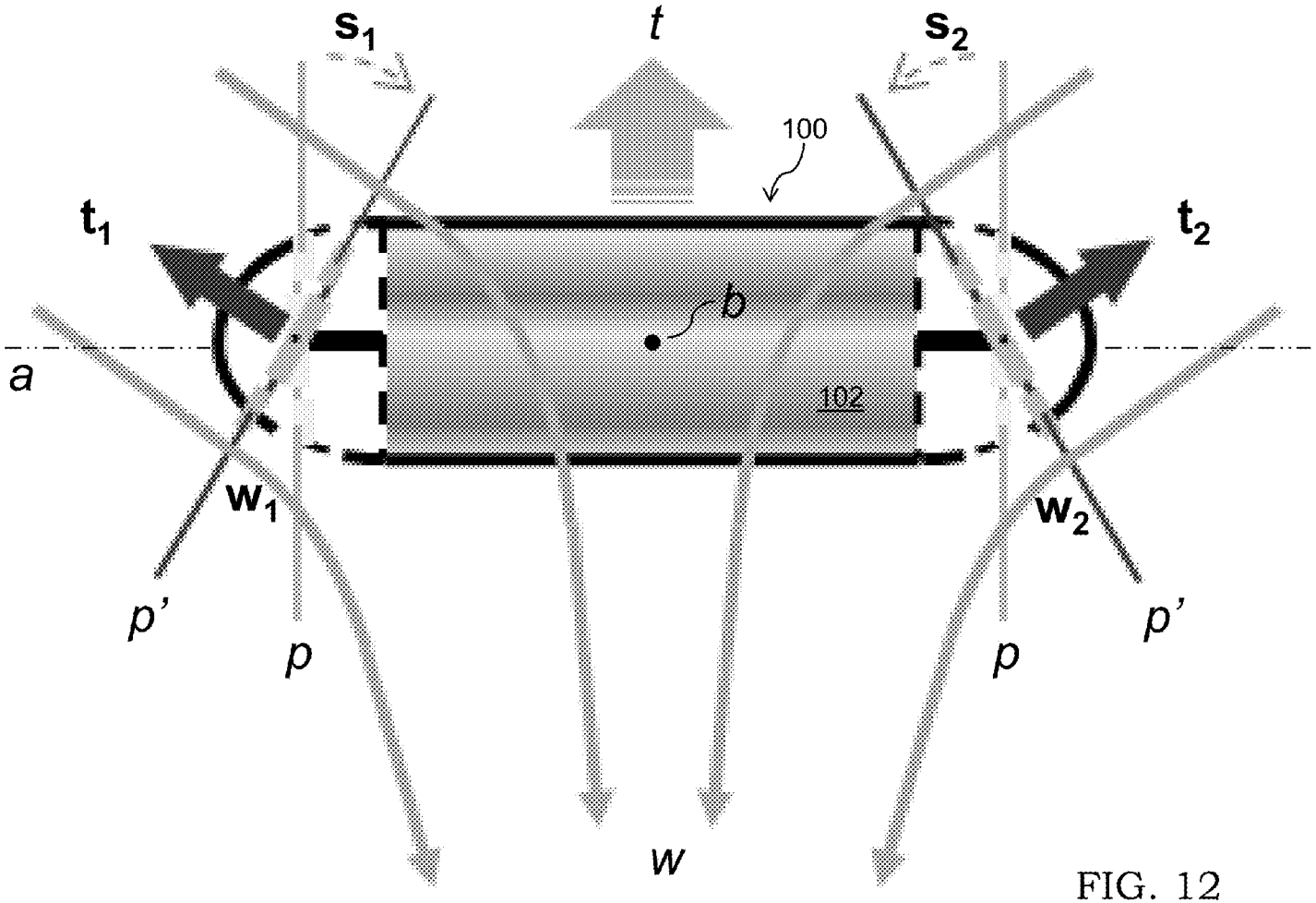
FIG. 12 exemplifies propulsive forces and sideways translation of an inventively equipped underwater marine vehicle such as shown in FIGS. 10 and 11.
Figure 13:
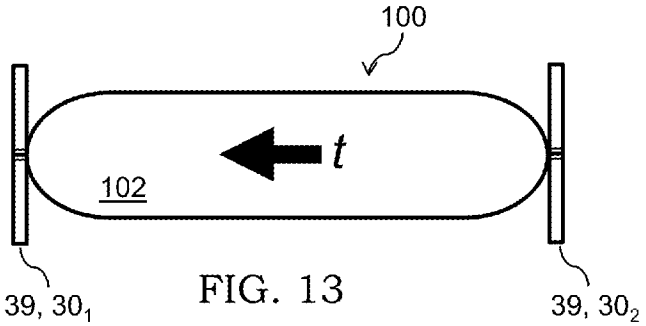
FIG. 13 through FIG. 18 exemplify some thrust-vectoring and maneuvering orientations among the practically infinite number of translational and rotational movements that are possible, in six degrees of motion, according to typical inventive practice of marine propulsion and control.
Figure 14:
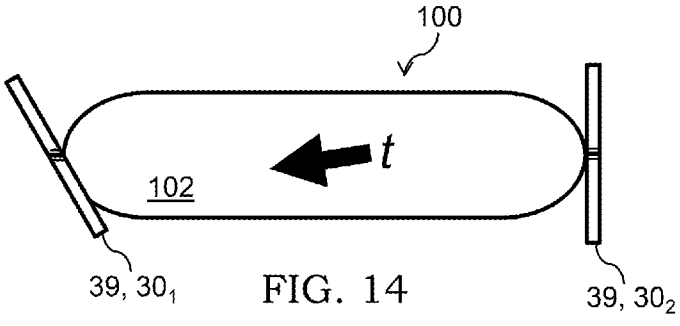
Figure 15:
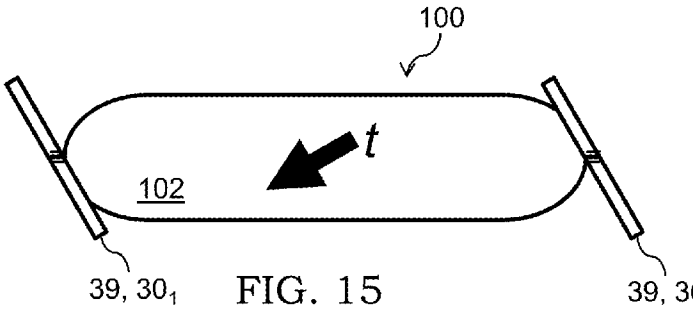
Figure 16:
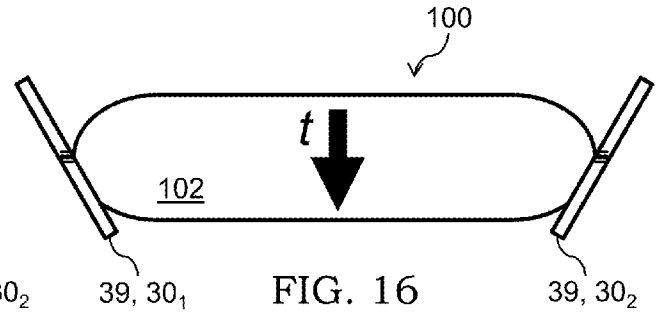
Figure 17:
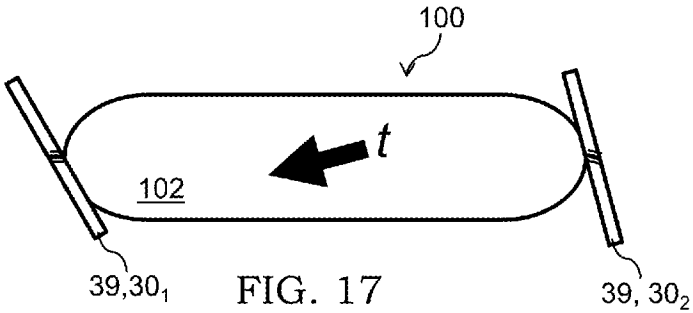
Figure 18:
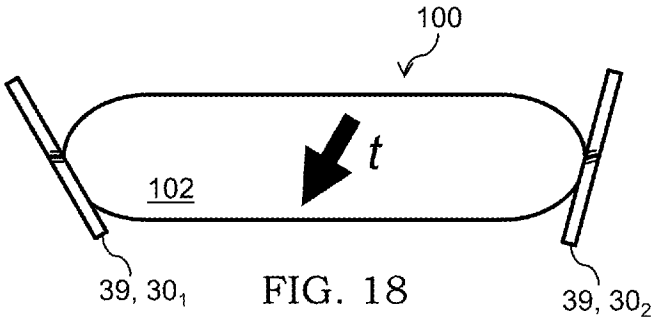

Referring especially to FIG. 10 through FIG. 18, the conceptually depicted example of an inventive submersible (such as a UUV) 100, includes a hull (body) 102 and two coaxial contra-rotating propellers 30, viz., propellers $\mathbf{30}_1$ and $\mathbf{30}_2$. Hull 102 is characterized by a longitudinal axis a. The two coaxial propellers $\mathbf{30}_1$ and $\mathbf{30}_2$ are congruent and contra-rotational and are respectively located in the vicinity of (i.e. at or near) the two opposite longitudinal-axial ends of the submersible's hull 102. Each propeller can be coupled with the hull 102 for instance either in a more discrete manner outboard of and proximate a longitudinal endpoint of hull 102 (such as illustrated in FIGS. 10, 11, and 13-18), or in a more integrative manner inboard of and proximate a longitudinal endpoint of hull 102 (such as illustrated in FIG. 12).

The two contra-rotating directions $r_1$ and $r_2$ of propellers 30 are indicated in FIG. 10. Propeller $\mathbf{30}_1$ rotates in rotational direction $r_1$, and propeller $\mathbf{30}_2$ rotates in rotational direction $r_2$, which is opposite rotational direction $r_1$. The turning of the propellers $\mathbf{30}_1$ and $\mathbf{30}_2$ in opposite directions serves to counteract the effects of rotary torque, and to help maintain the orientation of the longitudinal axis a of hull 102 in concordance with the nautical bearing of the vehicle 100.

According to typical inventive practice, the propellers 30 are same or similar or comparable, vis-à-vis each other, dimensionally and configurationally and operationally; however, some inventive embodiments provide for incongruity or dissimilarity in any of these respects between the two propellers. Further according to typical inventive practice, hull 102 is approximately symmetrical about a longitudinal axis a and a geometric three-dimensional center point b. Frequent inventive practice provides for a hull 102 describing a geometric shape that is either approximately cylindrical (such as shown in FIGS. 10-18) or approximately prolate spheroidal. The shaft 32 of each propeller 30 approximately coincides with the longitudinal axis a of hull 32. Nevertheless, the hull need not be symmetrical in inventive practice. The present invention can be practiced in association with symmetrical or asymmetrical hulls of diverse shapes.

Although the locations of propellers $\mathbf{30}_1$ and $\mathbf{30}_2$ may be described as fore and aft, the distinction between "fore" and "aft" may constitute a distinction without a difference in some inventive applications, such as involving some types of UUVs. The symmetry of the vehicular hull 102 advances the dynamic versatility of the vehicle 100 in terms of mobility in every direction in every degree of freedom. A typical embodiment of an inventive UUV applies inventive control to two identical propellers 30 in a coordinated fashion, and is thereby capable of translation and/or rotation in any degree or combination of degrees among the six degrees of freedom, and in any direction or directions, axially (forward-and-backward) or transversely (side-to-side) or some combination thereof.

Inventive submersible 100 can be considered to have two separate electrical control systems, viz., (i) a propeller blade-pitch control subsystem 80 (such as shown in FIG. 11), and (ii) a propeller rotational speed (e.g., rpm) control subsystem 70 (such as shown in FIG. 10).

As shown in FIG. 10, rotational speed control subsystem 70 includes a prime mover (e.g., an engine or motor) 71 and a transmission 72. Prime mover 71 turns each propeller shaft and thereby drives each propeller 30 via a corresponding transmission 72. Depending on the inventive embodiment, one or plural engines/motors 71 can be used, and of any of various types including but not limited to electric, internal combustion reciprocating, and turbine. Typical inventive practice provides for a driven rotational speed of propellers 30 that is about constant or that falls within a narrow range. The actual rotational speed of each propeller 30 can be adjusted through varying the power or speed of the engine/motor 71.

As shown in FIG. 11, blade-pitch control subsystem 80 includes a blade-pitch command component 81 and a blade-pitch activation component 82. Blade-pitch command component 81 can include an onboard operator/pilot, a remote operator/pilot, an onboard computer, or a remote computer, or some combination thereof. Blade-pitch activation component 82 can include any or any combination of diverse mechanical devices and/or electronic devices, such as electronic actuators and mechanical actuators (e.g., swashplates). Blade-pitch control subsystem 80 controls the pitch angles of blades 36 by rotating blades 36 to the selected pitches.

An inventive vehicle 100 can be autonomous, or piloted inside the vehicle, or piloted outside the vehicle, or controlled through some combination thereof. In any of these modes, blade-pitch command component 81 can include one or more computers, onboard and/or remote, or can be entirely exclusive of computers. For instance, inventive practice may provide for a blade-pitch command component 81 that includes an onboard computer 83, which controls the pitch angles of blades 36 by transmitting electrical signals to pitch-variation devices 82, which in turn rotate the blades 36 to the selected pitches. Computer 83 includes a processor and a memory and blade-pitch control algorithmic software 84 resident in its memory. The computer executes the algorithmic program and sends attendant signals to electronically adjust the individual blade pitch angles of both propellers.

Inventive practice can avail itself of known rotor control technology, including some more advanced rotor control techniques. According to frequent inventive practice, every blade 36 has an electronic actuator associated therewith. Additionally or alternatively, the present invention can use a mechanical actuator of the swashplate variety as used in most current helicopters, one swashplate determining the respective pitch angles of all of the blades 36 of one propeller 30. More typical inventive practice provides for individual blade control, such illustrated in FIGS. 1 through 8, which usually obviates the need for or suitability of a swashplate. According to some inventive embodiments, ring drive motors are used, thereby eliminating the entire rotor head and drive shaft.

Although cyclic and collective blade control of marine propulsors is known (See, e.g., the afore-noted U.S. Pat. Nos. 5,028,210 and 5,249,992), the blades have always been fixed, thus prohibiting articulation. The present invention incorporates flapping articulation in a Haselton dual-propulsor arrangement. By attributing the propulsor blades with flappability, the present invention greatly improves the ability of the propulsion system to generate off-axis forces, thereby greatly improving the maneuverability and controllability of the vehicle.

In each propeller 30, each blade 36 has a blade tip 39. According to typical inventive practice, computer 80 (having pitch-control algorithm 82 in its memory) directs variable-pitch actuators 82, each associated with its own blade 36, to vary their respective pitches; additionally or alternatively, computer 80 varies the respective pitches of the blades 36 of a propeller 30 through mechanical swashplate 82. These electronically actuated changes of the blade pitches of one, some, or all of blades 36 of propeller 30 result in selected flapping articulations of the blades 36. Blade pitch changes that are cyclically controlled result in selected apparent orientations of the tip path plane of the propeller. As illustrated in FIG. 10, the zero-angle tip-path plane, geometric plane p, is perpendicular to the longitudinal axis a of vehicular hull 32. Geometric plane p thus describes the "default" tip-path plane, which has associated therewith a "default" blade configuration.

As illustrated in FIG. 11, the blade-pitch variations cause flapping articulations of the propeller blades 36, with resultant movement (flapping) of the propeller blades 36 into a different tip-path plane. For instance, propeller blades 36 can describe zero-angle tip-path plane p, then move out of zero-angle tip-path plane p to describe oblique-angle tip path plane p'. Or, propeller blades 36 can describe an oblique-angle tip path plane p', then move out of oblique-angle tip path plane p' to describe zero-angle tip-path plane p. Or, propeller blades 36 can describe a first oblique-angle tip path plane p', then move out of the first oblique-angle tip path plane p' to describe a second oblique-angle tip path plane p'.

In other words, the flapping articulations can cause the blades 36 to tilt from zero-angle tip path plane p to oblique-angle tip path plane p'. The flapping articulations can also cause the blades 36 to tilt from oblique-angle tip path plane p' to zero-angle tip path plane p. The flapping articulations can also cause the blades 36 to tilt from an oblique-angle tip path plane p' to a different oblique-angle tip path plane p'. Zero-angle tip path plane p and an infinite number of oblique-angle tip path planes p' represent the infinite orientations of the geometric plane in which the path of the blade tips 39 may lie as a consequence of the actuated blade pitch and resulting blade motion.

According to typical inventive practice, the obliqueness of plane p' with regard to zero-angle plane p can be in any direction. In other words, any slant of oblique-angle p' with respect to zero-angle plane p is possible in any direction in a full 360° circle around the geometric point at which longitudinal axis a intersects zero-angle plane p. Computer-controlled cyclic adjustment of blade pitch angles of a propeller 30 changes the apparent orientation of the tip path plane of the propeller 30—e.g., from zero-angle plane p to an oblique-angle plane p', or from an oblique-angle plane p' to zero-angle plane p, or from a first oblique-angle plane p' to a second oblique-angle plane p'.

According to typical inventive practice, blade pitch control capability is both cyclic and collective. At any point in time, blade pitch can be controlled either cyclically, or collectively, or both cyclically and collectively. The present invention's unique ability to impel and turn vehicle 100 in any direction at any time, regardless of speed, springs from the present invention's unique combination of (i) collective and cyclic blade pitch control of each propeller 30 and (ii) flapping articulation of each propeller 30.

Cyclic control increases and decreases the pitch angles of the propeller blades as the blades rotate through a revolution. Blade pitch on each propeller 30 is cyclically controlled to adjust the orientation of a propeller 30, i.e., its geometric tip path plane p or p', thereby adjusting the thrust (propulsive force) of the propeller 30. The direction of thrust $t_1$ of propeller $\mathbf{30}_1$ is approximately perpendicular to the tip path plane of propeller $\mathbf{30}_1$. The direction of thrust $t_2$ of propeller $\mathbf{30}_1$ is approximately perpendicular to the tip path plane of propeller $\mathbf{30}_2$. Adjusting the tip path plane of propeller $\mathbf{30}_1$ serves to adjust the direction of its thrust $t_1$. Likewise, adjusting the tip path plane of propeller $\mathbf{30}_2$ serves to adjust the direction of its thrust $t_2$. The overall direction of thrust t, and hence the overall direction of travel of the vehicle 100, is determined by the combination of thrusts $t_1$ and $t_2$. In addition, cyclic control induces a moment on the vehicle, causing change in overall vehicle orientation (e.g., "steering").

Collective control concurrently and equally increases or decreases the pitch angles of the propeller blades. Blade pitch on each propeller 30 is collectively controlled to adjust the amount of overall thrust t generated, and the fore-versus-aft direction of overall thrust t. In other words, collective control determines how fast vehicle 100 is moving, and whether vehicle 100 is moving "forward" or "backward" in terms of vehicle 100's longitudinal axis a.

Cyclic control brings about changes in the orientation of a propeller 30, which are accompanied by corresponding changes in the direction of the thrust t of the propeller 30. FIG. 12 shows, for instance, cyclic adjustment of: propeller $\mathbf{30}_1$ in rotational direction $r_1$ from zero-angle tip path plane $p_1$ to oblique-angle tip path plane $p_1'$; and, propeller $\mathbf{30}_2$ in rotational direction $r_2$ from zero-angle tip path plane $p_2$ to oblique-angle tip path plane $p_2'$. Zero-angle tip path plane $p_1$ and zero-angle tip path plane $p_2$ are parallel to each other, each being perpendicular to longitudinal axis a. Oblique-angle tip path plane $p_1'$ and oblique-angle tip path plane $p_2'$ are equal and opposite in orientation relative to zero-angle tip path plane $p_1$ and zero-angle tip path plane $p_2$, respectively. As to propellers $\mathbf{30}_1$ and $\mathbf{30}_2$, the resultant acceleration of the water, viz., $w_1$ and $w_2$, respectively, initially is generally opposite the resultant thrust, viz., $t_1$ and $t_2$, respectively. The combined effects of thrusts $t_1$ and $t_2$ is overall thrust t. The underwater vehicle 100 moves sideways in a navigational direction in accordance with thrust t. Generally speaking, thrust t is opposite the overall acceleration w of the water, parallel to geometric planes $p_1$ and $p_2$, and perpendicular to vehicular hull 102's longitudinal axis a.

At any given time during inventive propulsive operation, orientational change can be selectively applied to neither, either, or both propellers 30. The present invention's capability of changing the orientation of one or both propellers 30 enables complete directional control of the underwater vehicle 100, such as depicted by way of example in FIGS. 12-18. Typical inventive embodiments provide for computer control, both cyclic and collective, of the blade pitch angles of two coaxial propellers. The thrust can be nominally perpendicular in either direction with respect to the blade tip path plane of a propeller, depending on the direction of the collective pitch.

Some inventive embodiments provide, in addition, for computer control of other propulsive characteristics, such as rotational speed and/or rotational direction of propellers 30. As shown in FIG. 10, in addition to being connected and sending signals to blade pitch variation actuators 82, computer 80 can also be connected to and send signals to engine/motor(s) 70 and/or transmissions 72. Inventive practice may incorporate computer control of other propulsive parameters such as these so as to enhance the controllability and maneuverability of the marine vehicle 100.

The present invention, which is disclosed herein, is not to be limited by the embodiments described or illustrated herein, which are given by way of example and not of limitation. Other embodiments of the present invention will be apparent to those skilled in the art from a consideration of the instant disclosure, or from practice of the present invention. Various omissions, modifications, and changes to the principles disclosed herein may be made by one skilled in the art without departing from the true scope and spirit of the present invention, which is indicated by the following claims.

What is claimed is:

1. A propulsion-and-control system for association with an elongate marine vehicle having a longitudinal axis and two longitudinal-axial ends, the propulsor-and-control system comprising two propellers for coaxial situation at said two longitudinal-axial ends, each of said two propellers including a linear structure and a teeter hinge, said linear structure being connected at the middle of said linear structure to said teeter hinge, said linear structure including two colinear blades that are in fixed position with respect to each other and that adjoin at said middle of said linear structure, said two colinear blades geometrically describing a geometric tip-path plane and each being characterized by a flap angle, said linear structure being capable of teetering on said teeter hinge so as to vary said geometric tip-path plane in an orientation corresponding to the respective said flap angles of said two colinear blades, wherein a non-oblique said orientation of said geometric tip-path corresponds to respective said flap angles that are zero flap angle, wherein an oblique said orientation of said geometric tip-path corresponds to respective said flap angles that are positive flap angle and negative flap angle of equal magnitude, the propulsor-and-control system further comprising a blade-pitch control subsystem, said blade-pitch control subsystem being capable of cyclically varying the respective said pitch angles of said two colinear blades in order to select for each of said two propellers a said geometric tip-path plane geometrically described by said two colinear blades, wherein a direction of thrust of each of said two propellers is perpendicular to said tip-path plane, and wherein the respective said directions of thrust of said two propellers determine an overall direction of thrust of the elongate marine vehicle and hence a direction of motion of the elongate marine vehicle.

2. The propulsion-and-control system of claim 1 wherein said blade-pitch control subsystem includes a computer.

3. The propulsion-and-control system of claim 1 wherein said blade-pitch control subsystem is further capable of collectively varying the respective said pitch angles of said two coaxial blades in order to determine an amount of thrust of each of said two propellers, wherein the respective said amounts of thrust of said two propellers determine an overall amount of thrust of the elongate marine vehicle and a longitudinal-axial direction of motion of the elongate marine vehicle.

4. The propulsion-and-control system of claim 3 wherein said blade-pitch control subsystem includes a computer.

5. A computer-implemented system for propelling and controlling an underwater vehicle having a substantially symmetrical elongate hull characterized by a geometric longitudinal axis and two axial hull ends, the computer-implemented system comprising:

plural pitch hinges;

plural flapping hinges;

plural pitch actuators, for activating said plural pitch hinges;

a pair of coaxial propellers respectively situated in the vicinity of said two axial hull ends, each of said pair of coaxial propellers including a propeller hub and a linear double-blade propeller unit, said linear double-blade propeller unit having two colinear congruent blades that are in fixed position with respect to each other and that meet at said propeller hub, each of said two colinear congruent blades being associated with at least one of said plural pitch hinges so as to facilitate variation of a blade pitch angle of said colinear congruent blade; said linear double-blade propeller unit being associated with at least one of said plural flapping hinges so as to facilitate teetering of said linear double-blade unit about said hub, said teetering being characterized by equal and opposite variation of respective blade flap angles of said two colinear congruent blades whereby said two colinear congruent blades geometrically describe a geometric tip-path plane that varies in orientation in accordance with said equal and opposite variation of the respective said flap angles of said two colinear congruent blades; and a computer electrically connected to said plural pitch actuators, said computer being configured to execute computer program logic that, when executed, is capable of moving the underwater vehicle in six degrees of freedom, wherein according to the computer program logic:

as to each of said pair of coaxial propellers, said blade pitch angle of each of said two colinear congruent blades is cyclically varied so as to vary said orientation of said geometric blade-tip-path plane geometrically described by said two colinear congruent blades, said geometric blade-tip-path plane determining a direction of thrust exerted by said propeller, said direction of thrust being perpendicular to said geometric-tip-path plane;

said geometric blade-tip-path planes of the respective said pair of coaxial propellers are selected to maneuver said underwater vehicle, said pair of coaxial propellers together exerting a thrust representing a combination of the directions of the thrusts of the respective said pair of coaxial propellers.

6. The computer-implemented system of claim 5, wherein further according to the computer program logic:

as to each of said pair of coaxial propellers, said blade pitch angle of each of said two colinear congruent blades is collectively varied so as to vary said orientation of said geometric tip-path plane, thereby determining an amount of thrust of said propeller;

said amounts of thrust of the respective said pair of coaxial propellers are selected to control speed and to establish one of two opposite longitudinal-axial directions of said underwater vehicle.

7. The computer-implemented system of claim 6, wherein:

said geometric blade-tip-path planes of the respective said pair of coaxial propellers result in individual thrusts of the respective said propellers;

an aggregate thrust is exerted by said propellers that is based on a combination of said individual thrusts;

said underwater vehicle is maneuvered in a direction concordant with said aggregate thrust.

8. The computer-implemented system of claim 7 further comprising at least one prime mover and plural transmissions for contra-rotating said pair of coaxial propellers.

9. The computer-implemented system of claim 8 wherein said pair of coaxial propellers are contra-rotated at approximately a same rotational speed.

10. The computer-implemented system of claim 7 wherein said plural flapping hinges are at least one of flexible and mechanical.

11. The computer-implemented system of claim 7 wherein said pair of coaxial propellers are congruent and each of said pair of coaxial propellers includes one said linear double-blade propeller unit.

12. The computer-implemented system of claim 7 further comprising plural lead-lag hinges, each of said two colinear congruent blades being associated with at least one of said lead-lag hinges.

13. An underwater vehicle comprising:

a substantially symmetrical elongate hull characterized by a geometric longitudinal axis and two axial hull ends;

plural pitch hinges;

plural flapping hinges;

plural pitch actuators, for activating said plural pitch hinges;

a pair of coaxial propellers respectively situated in the vicinity of said two axial hull ends, each of said pair of coaxial propellers including a propeller hub and a linear double-blade propeller unit, said linear double-blade propeller unit having two colinear congruent blades that are in fixed position with respect to each other and that meet at said propeller hub, each of said two colinear congruent blades being associated with at least one of said plural pitch hinges so as to facilitate variation of a blade pitch angle of said colinear congruent blade; said linear double-blade propeller unit being associated with at least one of said plural flapping hinges so as to facilitate teetering of said linear double-blade unit about said hub, said teetering being characterized by equal and opposite variation of respective blade flap angles of said two colinear congruent blades whereby said two colinear congruent blades geometrically describe a geometric tip-path plane that varies in orientation in accordance with said equal and opposite variation of the respective said flap angles of said two colinear congruent blades; and a computer electrically connected to said plural pitch actuators, said computer being configured to execute computer program logic that, when executed, is capable of moving the underwater vehicle in six degrees of freedom, wherein according to the computer program logic:

as to each of said pair of coaxial propellers, said blade pitch angle of each of said two colinear congruent blades is cyclically varied so as to vary said orientation of said geometric blade-tip-path plane geometrically described by said two colinear congruent blades, said geometric blade-tip-path plane determining a direction of thrust exerted by said propeller, said direction of thrust being perpendicular to said geometric-tip-path plane;

said geometric blade-tip-path planes of the respective said pair of coaxial propellers are selected to maneuver said underwater vehicle, said pair of coaxial propellers together exerting a thrust representing a combination of the directions of the thrusts of the respective said pair of coaxial propellers.

14. The underwater vehicle of claim 13, wherein further according to the computer program logic:

as to each of said pair of coaxial propellers, said blade pitch angle of each of said two colinear congruent blades is collectively varied so as to vary said orientation of said geometric tip-path plane, thereby determining an amount of thrust of said propeller;

said amounts of thrust of the respective said pair of coaxial propellers are selected to control speed and to establish one of two opposite longitudinal-axial directions of said underwater vehicle.

15. The underwater vehicle of claim 14, wherein:

said geometric blade-tip-path planes of the respective said pair of coaxial propellers result in individual thrusts of the respective said propellers;

an aggregate thrust is exerted by said propellers that is based on a combination of said individual thrusts;

said underwater vehicle is maneuvered in a direction concordant with said aggregate thrust.

16. The underwater vehicle of claim 15 further comprising at least one prime mover and plural transmissions for contra-rotating said pair of coaxial propellers.

17. The underwater vehicle of claim 16 wherein said pair of coaxial propellers are contra-rotated at approximately a same rotational speed.

18. The underwater vehicle of claim 15 wherein said plural flapping hinges are at least one of flexible and mechanical.

19. The underwater vehicle of claim 15 wherein said pair of coaxial propellers are congruent and each of said pair of coaxial propellers includes one said linear double-blade propeller unit.

20. The underwater vehicle of claim 15 further comprising plural lead-lag hinges, each of said two colinear congruent blades being associated with at least one of said lead-lag hinges.

* * * * *